United States Patent [19]

Williams

[11] Patent Number: 4,585,235

[45] Date of Patent: Apr. 29, 1986

[54] TABLE BALL GAME APPARATUS

[76] Inventor: Jerry D. Williams, 815 W. Ave. A, Elk City, Okla. 73644

[21] Appl. No.: 701,188

[22] Filed: Feb. 13, 1985

[51] Int. Cl.[4] ..... A63F 7/00

[52] U.S. Cl. ..... 273/355; 273/119 R; 273/129 W; 273/357; 273/399

[58] Field of Search ..... 273/85 B, 85 D, 119 R, 273/355, 356, 357, 399, 30, 129 W

[56] References Cited

U.S. PATENT DOCUMENTS

| | | | |
|---|---|---|---|
| 2,083,119 | 6/1937 | Hense | 273/119 R |
| 2,665,908 | 1/1954 | Gray | 273/76 |
| 3,064,978 | 11/1962 | Burch | 273/119 R |
| 3,087,731 | 4/1963 | Waite | 273/119 R |
| 3,643,955 | 2/1972 | Breslow | 273/119 R |
| 3,891,210 | 6/1975 | Van Horne | 273/30 |
| 3,995,859 | 12/1976 | Goldfarb et al. | 273/85 B |
| 4,010,952 | 3/1977 | Young | 273/30 |
| 4,046,380 | 9/1977 | Goldfarb et al. | 273/119 R |
| 4,307,882 | 12/1981 | Hay et al. | 273/30 |
| 4,325,555 | 4/1982 | Marling | 273/357 X |
| 4,334,681 | 6/1982 | Scheie | 273/30 |
| 4,350,344 | 9/1982 | Bear | 273/357 X |

FOREIGN PATENT DOCUMENTS

| | | | |
|---|---|---|---|
| 2536255 | 2/1977 | Fed. Rep. of Germany | 273/119 R |
| 1071526 | 3/1954 | France | 273/119 R |

*Primary Examiner*—Anton O. Oechsle

*Attorney, Agent, or Firm*—Norman B. Rainer

[57] ABSTRACT

Apparatus is provided for enabling two or four people to play a competitive game involving skillful manipulative control of a ball on a horizontal game surface. The apparatus comprises a flat playing surface of substantially square perimeter supported by four legs adapted to maintain the playing surface at table height. A retaining wall is associated with each side of said perimeter, and at least one ball-receiving goal is associated with each retaining wall. An elongated sliding guide is positioned parallel to each retaining wall, and a paddle slidably engages each guide. The paddle, having a flat striking portion disposed below the sliding guide, and an elongated handle portion extending above the guide, can be rotated about the handle portion and pivoted about the guide. The striking portion of the paddle is utilized to hit a playing ball having the general characteristics of a table tennis ball.

7 Claims, 5 Drawing Figures

TABLE BALL GAME APPARATUS

BACKGROUND OF THE INVENTION

This invention concerns apparatus of table height for enabling two or four people to play a competitive game involving skillful manipulative control of a ball on a horizontal game surface.

In the well known game of Ping-Pong or table tennis, each player utilizes a paddle in a striking manner to control the movement of a light-weight, high-bouncing ball upon a horizontally disposed flat rectangular surface positioned at table height. An important requirement of Ping-Pong is to cause the ball to clear a divider net upraised from the table. Accordingly, the ball is caused to travel generally above the table, making only bouncing contact with the playing surface.

In pool or billiard games, a heavy ball is caused to traverse the playing surface in rolling contact therewith, the ball being aimed at specific targets such as other balls or depressed cups positioned about the perimeter of the playing surface.

Table-based competitive games patterned upon football, soccer or hockey principles, generally utilize a number or "team" of hand-manipulated striking members for propelling a ball upon a flat horizontal toward an opponent's "goal", usually a depressed cup adjacent the periphery of the playing surface.

The hand manipulative skills involved in the aforesaid competitive table games are so different that excellence of performance in one game will not assure excellence in another. Such games therefore provide sufficient variety to appeal to the particular interests and abilities of many people. Even further modifications of skill-based competitive table games would find widespread acceptance if characterized by novel and challenging features and greater versatility of playing modes.

It is accordingly an object of the present invention to provide apparatus for playing a skill-based competitive table game.

It is another object of this invention to provide apparatus as in the foregoing object involving hand-manipulative control of means for striking a playing ball.

It is a further object of the present invention to provide apparatus of the aforesaid nature involving movement of a struck ball upon a flat horizontal playing surface provided with ball-receiving goals.

It is still another object of this invention to provide apparatus of the aforesaid nature for a game that can be played by 2 or 4 persons.

These objects and other objects and advantages of the invention will be apparent from the following description.

SUMMARY OF THE INVENTION

The above and other beneficial objects and advantages are accomplished in accordance with the present invention by an apparatus comprising:

(a) a flat horizontally disposed playing surface of substantially square perimeter, (b) at least four support legs adapted to maintain said playing surface at table height above a floor, (c) a playing ball having the general characteristics of a table tennis ball, (d) at least one ball-receiving goal associated with each side of said perimeter, (e) a retaining wall associated with each side of said perimeter, and rising upwardly from said playing surface, (f) elongated sliding guide means associated with each side of said perimeter, and (g) a paddle slidably engaged by each guide means in a manner permitting translational movement above the playing surface, said paddle having an elongated handle portion extending above said guide means and a flat striking portion extending below said guide means, the paddle being rotatable about the axis of elongation of said handle portion, and pivotable about said guide means.

In a preferred embodiment of the apparatus, a pair of removable fence panels is provided to block off the goals on opposite sides of the playing surface to facilitate playing of the game by two persons. Deflector means may be centrally positioned upon the playing surface. Scorekeeping means may be provided atop the support legs or retaining walls. Printed indicia may be associated with the playing surface to enhance the playing of the game. The goal is preferably an opening or portal in the sidewall having an associated pocket exterior to the playing surface and adapted to catch a ball passing through said portal. Restricting means may be provided above each goal to prevent inadvertent entry of the striking portion of the paddle into the goal. In further embodiments, two goals may be positioned in each sidewall. Auxiliary retaining walls may be positioned in the corners of the playing surface.

In playing the game, players on facing sides manipulate their paddles in a manner to drive the ball into a goal on their opponent's side of the table. Defensively, each player manipulates the paddle to try to block entrance of the ball into a goal on his side. The game is scored based upon the number of goals, namely the passage of the ball into an opponent's goal.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
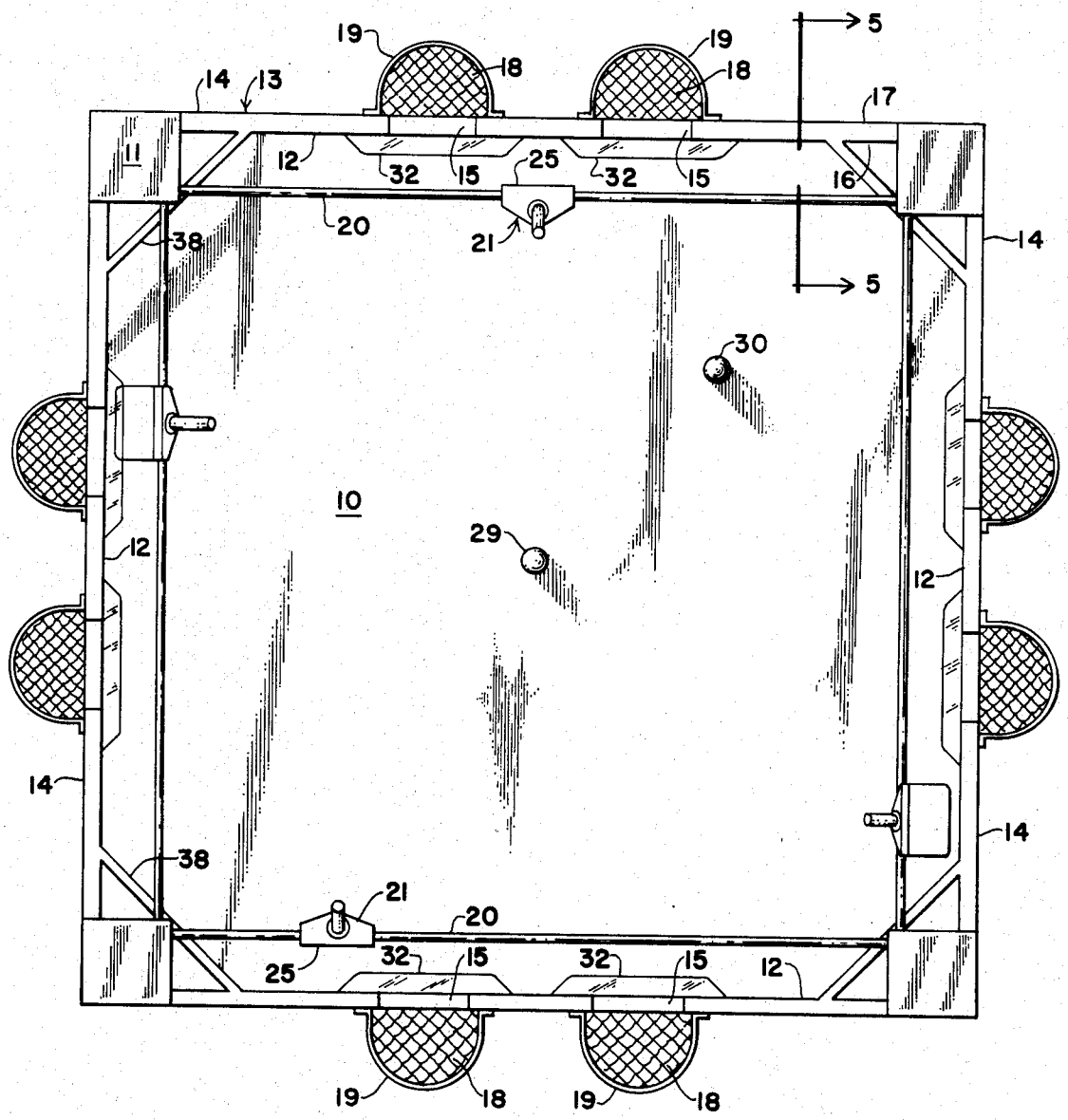
FIG. 1 is a top plan view of an embodiment of the apparatus of this invention.
Figure 2:
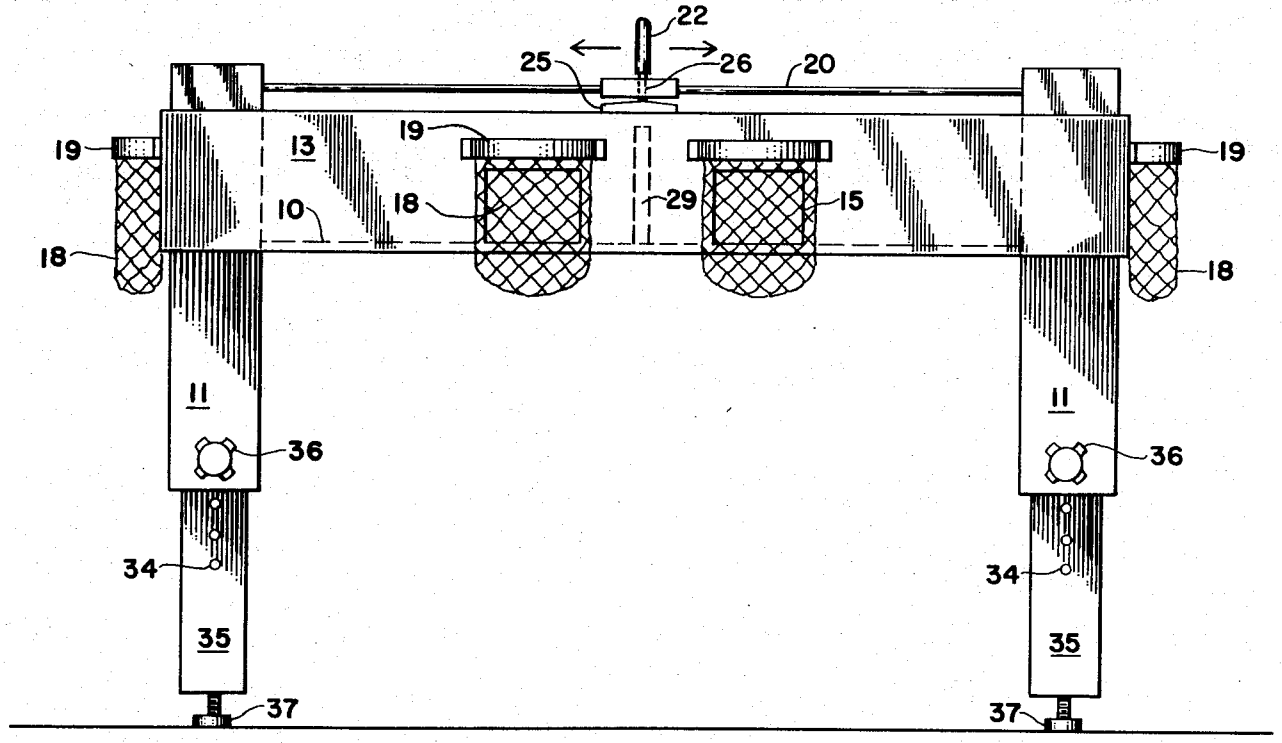
FIG. 2 is a side view of the embodiment of FIG. 1, all four sides having substantially the same appearance.
Figure 3:
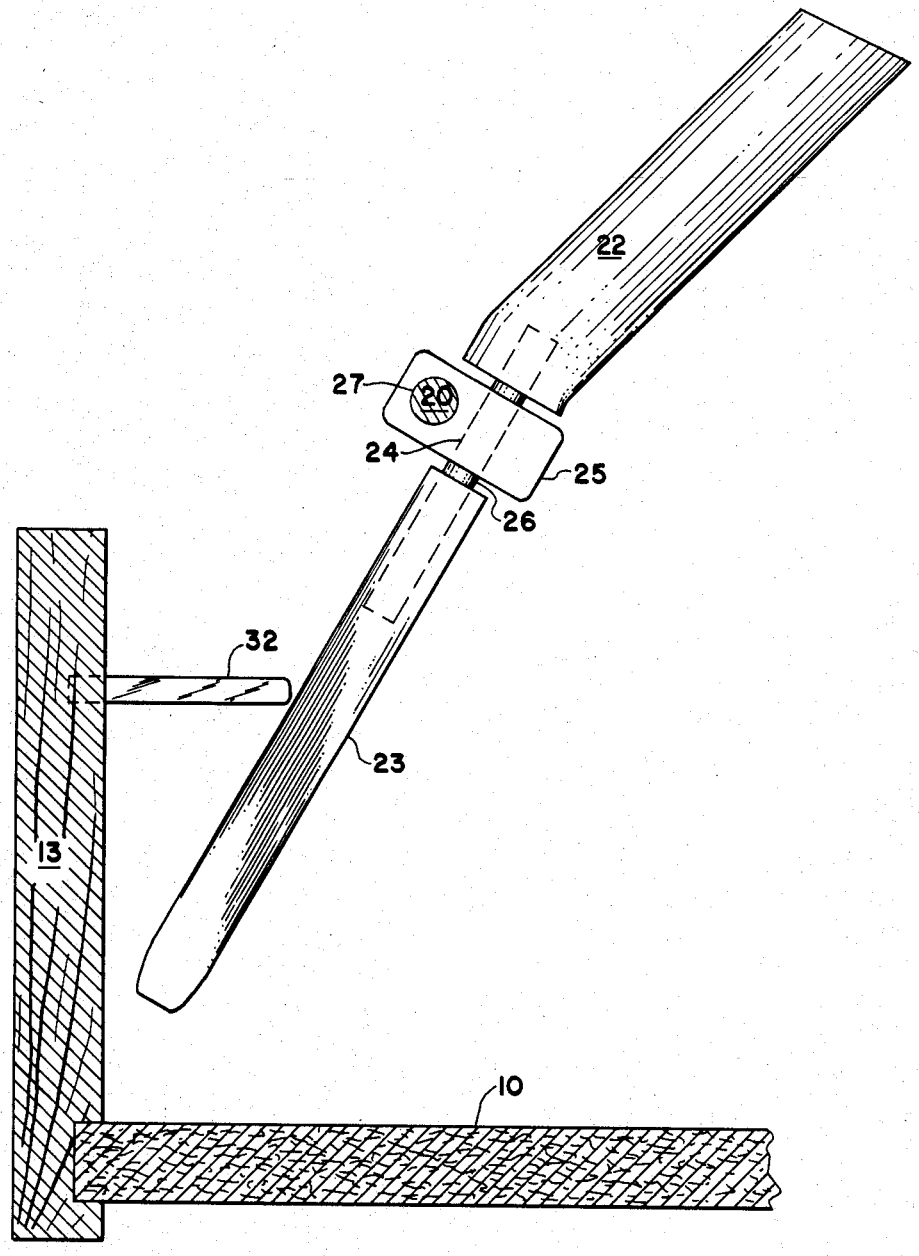
FIG. 3 is an enlarged side view of a paddle in association with other components of the apparatus shown in section.
Figure 4:
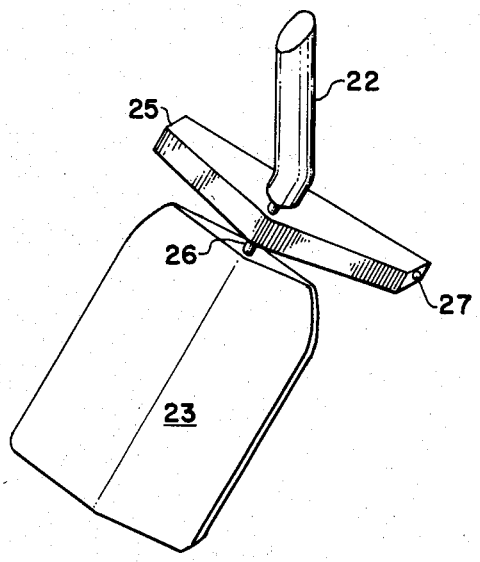
FIG. 4 is a perspective front view of the paddle of FIG. 3.

Referring to the drawing, an embodiment of the apparatus of this invention in the form of a playing table is shown comprised of playing surface 10 of square perimeter supported in horizontal disposition at table height by legs 11 positioned at each corner of the square perimeter. In preferred embodiments, the sides 12 of the square perimeter have a length of about 40 inches. The legs have a length such as to place the playing surface about 32 inches above the ground or floor upon which the table rests. The legs may have a telescoping construction provided with height adjustment means in the form of a series of holes 34 in an inner telescoping member 35, and a selector bolt controlled by knob 36. Threadably adjustable levelling footings 39 may be disposed below the lowermost extremity of each leg.

A retaining wall 13 of generally elongated rectangular configuration rises vertically from each side 12 of the playing surface, each retaining wall having inner and outer surfaces, 16 and 17, respectively. The end extremities 14 of the retaining walls are attached to the upper extremities of adjacent legs 11. An auxiliary retaining wall 38 is located in each corner of the playing surface in angled relationship to retaining walls 13. Two passageways or portals 15 are positioned in each sidewall, said portals being equidistantly spaced about the longitudinal midpoint of the retaining wall. Ball-catching means in the form of a mesh pouch 18 communicates with each portal by attachment to the outer surface 17 of the retaining wall. The pouch is constructed to open upwardly by virtue of its attachment to rigid frame 19 extending outwardly from outer surface 17.

Sliding guide means, in the form of guide rod 20 of circular cylindrical configuration, is positioned above the playing surface adjacent the inner surface of each retaining wall. Said rod is disposed in parallel relationship to both playing surface 10 and retaining wall 13, the ends of said rod being supported by the upper extremities of legs 11.

A paddle 21 is associated with each rod 20, said paddle being comprised of elongated handle portion 22 and flat striking portion 23 joined to said handle portion by dowel 26. The paddle is designed to have a plane of symmetry which perpendicularly bisects striking portion 23. The paddle is mounted in bearing block 25 by virtue of close-fitting, slidable passage of dowel 26 through first channel 24 in said block. The bearing block in turn is slidably mounted upon guide rod 20 by virtue of the close-fitting passage of said rod through second channel 27 perpendicularly disposed to said first channel within block 25. Because of the manner of association of the paddle with the bearing block and guide rod, the paddle can be translationally moved along each side of the playing surface, and can be tilted in a path vertically disposed to the playing surface. In a still further mode of movement, the paddle can be rotated about the axis of elongation of dowel 26, said axis lying within said plane of symmetry.

Obstacle means in the form of post 29 rises upwardly from the center of the playing surface. Although shown as a rod-like cylindrical shape in the exemplified embodiment, other shapes may be utilized.

A ball 30, having the diameter of a Ping-Pong ball and a weight equal to or greater than that of a Ping-Pong ball, namely three grams, is utilized in playing the game. The ball, preferably hollow and fabricated of plastic, has characteristics such that, when struck gently by the striking portion of a paddle, will roll upon the playing surface, and when struck sharply will travel substantially horizontally above the playing surface at a height below the upper edges of the retaining walls. The ball is designed to bounce in a lively manner off the obstacle means, paddles and retaining walls.

The presence of two goals in each retaining wall is preferable because it prevents a player from merely blocking his goal in a defensive manner with his paddle, thereby thwarting the offensive efforts of his opponent. Accordingly, the impossibility of blocking goals prevents passive play, and forces the players to act quickly and skillfully in both offensive and defensive maneuvers.

Figure 5:
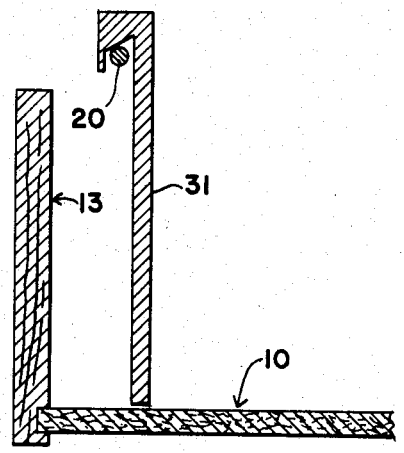
FIG. 5 is an enlarged sectional view taken along the lines 5—5 of FIG. 1 showing an embodiment utilizing fence panels to permit play by two persons.

A pair of removable fence panels 31 are provided having an elongated rectangular configuration generally matching the configuration of the retaining walls. The fence panels are hung from opposed guide rods in the manner shown in FIG. 5, thereby causing the game apparatus to be adapted to use by two players.

Restricting means in the form of standoff plates 32 are mounted to the inner surfaces of the retaining walls above each portal 15, their purpose being to prevent tilting movement of the striking portion of the paddle into the portal.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described the invention, what is claimed is:

1. An apparatus for enabling two or four people to play a competitive game involving skillful manipulative control of a ball on a horizontal game surface, said apparatus comprising:

(a) a flat horizontally disposed playing surface of substantially square perimeter, (b) at least four support legs adapted to maintain said playing surface at table height above a floor, (c) a playing ball having the general characteristics of a table tennis ball, (d) at least one ball-receiving goal associated with each side of said perimeter, (e) a retaining wall associated with each side of said perimeter, and rising upwardly from said playing surface, (f) elongated sliding guide means associated with each side of said perimeter, and (g) a paddle slidably engaged by each guide means in a manner permitting translational movement above the playing surface, said paddle having an elongated handle portion extending above said guide means and a flat striking portion extending below said guide means, the paddle being rotatable about the axis of elongation of said handle portion, and pivotable about said guide means.

2. The apparatus of claim 1 wherein auxiliary retaining walls are positioned in each corner of said playing surface.

3. The apparatus of claim 1 wherein said support legs are of adjustable height.

4. The apparatus of claim 1 provided with deflector means centrally positioned upon said playing surface.

5. The apparatus of claim 1 wherein restricting means are provided above each goal.

6. The apparatus of claim 1 wherein ball-catching means are associated with each goal.

7. The apparatus of claim 1 wherein a pair of removable panels is provided to cover goals on opposite sides of the playing surface, thereby facilitating playing of the game by two people.

* * * * *